United States Patent [19]

Takagi et al.

[11] 4,424,953

[45] Jan. 10, 1984

[54] DUAL-LAYER SINTERED VALVE SEAT RING

[75] Inventors: Yoshiaki Takagi, Tsurugashimamachi; Takeshi Sugawara, Oimachi; Setsuo Nii, Chino; Takayuki Matsuda, Okaya, all of Japan

[73] Assignees: Honda Giken Kogyo Kabushiki Kaisha; Teikoku Piston Ring Co., Ltd., both of Tokyo, Japan

[21] Appl. No.: 473,717

[22] Filed: Mar. 8, 1983

[30] Foreign Application Priority Data

Mar. 9, 1982 [JP] Japan ..... 57-35744

[51] Int. Cl.[3] ..... F01L 3/02

[52] U.S. Cl. ..... 251/368; 251/359; 123/188 S; 29/157.1 A

[58] Field of Search ..... 123/188 S; 29/157.1 A; 251/368, 359

[56] References Cited

U.S. PATENT DOCUMENTS

| | | | |
|---|---|---|---|
| 2,101,970 | 12/1937 | Wissler | 123/188 S |
| 2,296,460 | 9/1942 | McDonald | 123/188 S |
| 2,753,858 | 7/1956 | Honeyman et al. | 123/188 S |
| 2,753,859 | 7/1956 | Bartlett | 123/188 S |
| 3,028,850 | 4/1962 | Gleeson | 123/188 S |
| 3,428,035 | 2/1969 | Stefon et al. | 123/188 S |
| 4,346,684 | 8/1982 | Vossieck | 123/188 S |

*Primary Examiner*—A. Michael Chambers

*Attorney, Agent, or Firm*—Finnegan, Henderson, Farabow, Garrett & Dunner

[57] ABSTRACT

The present invention relates to a dual-layer sintered valve seat ring having high stiffness and strength. The features of such ring are: fusion infiltration of Cu into the pores of a ferrous sintered body; hard alloy particles dispersed in the matrix of the valve seat body; the composition of the base and the ferrous sintered body; high density; and, diffusion of an alloying element of the hard particles around them and into the matrix.

10 Claims, 4 Drawing Figures

DUAL-LAYER SINTERED VALVE SEAT RING

The present invention relates to a valve ring of an internal-combustion engine. More particularly the present invention relates to a ferrous-sintered dual-layer valve seat ring having an improved strength and stiffness.

Recently, internal combustion engines have been operated at a high rotation so as to increase the power thereof. In addition, in order to reduce the weight of an internal-combustion engine, the weight of the structual parts is recently being decreased. Thus, the quality demands for the structual parts, especially the exhaust-system, of an internal combustion engine become more and more severe.

It is now described how the power of an internal combustion engine is increased with regard to design of the cylinder head thereof. When the diameter of the intake and exhaust valves is increased, the intake efficiency and exhaust efficiency are increased. According to one of the methods which are now employed for increasing the power of an internal-combustion engine, the diameter of the intake and exhaust values is increased. Due to such an increase, the inner and outer diameters of valve seat rings is increased, and, the distance between the intake and exhaust holes is decreased. If the width of valve seat rings is a constant, the distance between the intake and exhaust holes considerably decreases, rendering the cylinder head incapable of withstanding a thermal load during operation of an internal-combustion engine, and cracks may form in the cylinder head between the intake and exhaust holes. It is difficult to increase the diameter of the intake and exhaust valves because the thickness of conventional valve seat rings cannot be decreased considerably without decreasing their inherent strength.

Therefore, it is an object of the present invention to decrease the thickness of a valve seat ring.

It is another object of the present invention to make the outer diameter of a valve seat ring such that a satisfactory strength is imparted to a cylinder head and to increase the inner diameter of a valve seat ring so as to increase the intake and exhaust efficiency of an internal combustion engine.

It is a further object of the present invention to improve the strength and stiffness of a ferrous-sintered dual-layer valve seat ring, while maintaining the heat-resistance and wear-resistance which are fundamental properties of a valve-seat ring.

In accordance with the objects of the present invention, there is provided a valve seat ring having a high strength and high stiffness and comprising a valve seat body having a surface in contact with a valve and a base for supporting the valve seat body, the valve seat body and base consisting of a ferrous sintered article having a dual-layer structure (hereinafter referred to as the dual-layer sintered body), wherein: a ferrous sintered body of the valve seat body comprises from 5% to 30% by weight of hard alloy particles having a hardness of Hv 500 or more and a matrix, in which said hard alloy particles are dispersed, and an alloying element of said hard alloy particles diffusing around said hard alloy particles and into the matrix; a ferrous sintered body of the base contains from 0.5% to 1.5% by weight of carbon, from 0.6% to 3.0% by weight of chromium, and at least one element selected from the group of phosphorus in an amount of from 0.1% to 0.6% by weight and boron in an amount of from 0.02% to 0.2%, based on the weight of the ferrous sintered body; and the dual layer sintered body has a density of 7.6 g/cm$^3$ or more and comprises a skeleton, pores formed by sintering (hereinafter referred to as sintered pores), and copper or a copper alloy which is fusion-infiltrated into the first portions of the sintered pores, said skeleton having a density of from 6.7 g/cm$^3$ to 7.1 g/cm$^3$, the percentage of said sintered pores and the percentage of the second portions of said sintered pores, in which said copper or copper alloy is not fusion-infiltrated, being 15% or less and 5% or less, respectively, based on the volume of the dual layer sintered body.

A valve seat ring comprising a valve seat body having a surface in contact with a valve and a base supporting the valve seat body, the valve seat body and base consisting of the dual-layer sintered body, is hereinafter referred to as the dual-layer sintered valve seat ring.

In the drawings

Conventionally, ferrous-sintered dual-layer valve seat rings have been manufactured in an attempt to decrease the material cost. That is, the valve seat body 1*a* (FIG. 1) is made of a sintered body of high-alloyed ferrous material, and the base 1*b* is made of a sintered body of inexpensive low-alloyed ferrous material. Sintering of the ferrous materials is an appropriate means of manufacturing a valve seat ring, because it has a relatively simple shape, and because various ferrous materials can be selected as the ferrous-sintered dual-layer valve seat ring.

Figure 1:
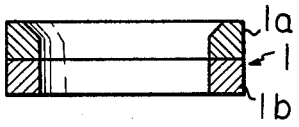
FIG. 1 is a schematic view of the dual-layer sintered valve seat ring.

Before completing the dual-layer sintered valve seat ring according to the present invention, the present inventors investigated a conventional ferrous-sintered dual-layer valve seat ring, such as the one shown in FIG. 1.

According to the present inventors' investigation of a conventional ferrous sintered dual-layer valve seat ring, since pores are usually formed on the sintered bodies, the stiffness characteristics for examples, the Young's modulus, thereof are not excellent.

The present inventors therefore recognized necessity of sealing the pores mentioned above. In addition, in a conventional ferrous sintered dual-layer valve seat ring, the stiffness and strength of the base 1*b* are lower than those of the valve seat body 1*a*. The present inventors therefore also recognized necessity of increasing the stiffness and strength of the base 1*b* to values equivalent to or greater than those of the valve seat body 1*a*.

The present invention is described in detail with regard to: (1) the composition of the valve seat body, (2) the composition of the base, (3) the method of compacting powders, (4) the skeleton density of the dual layer sintered body, (5) the fusion infiltration of copper or copper alloy, and (6) the metal structure.

Composition of the Valve Seat Body: Hard alloy particles are very wear-resistant and enhance the wear resistance of the valve seat body. Since an alloy element of hard alloy particles diffuses around the hard particles and therefore, is diffused in the matrix of the valve seat body the heat resistance of the matrix is increased. The diffused alloy element stengthens the bond between the hard alloy particles and the matrix, with the result that the strength of the valve seat body is increased.

The hard alloy particles must have a hardness of at least Hv 500 so that the hardness is at least equal to the hardness of a valve. When the amount of hard alloy particles is less than 5% by weight, the particles are not effective for enhancing the wear resistance of the valve seat body. When the amount of hard alloy particles is more than 30%, cracks may form during compacting of the raw sintering powders, the life of dies used for compacting the raw sintering powders short, and the change in dimension of a green compact is excessively great during sintering. It is preferred that the valve seat body comprises from 5% to 30%, preferably from 10% to 25%, by weight, of hard alloy particles.

Hard alloy particles can be easily obtained by casting a high alloy material, such as a Fe-C-Cr-Mo-Co-Ni alloy, crushing the cast body, and adjusting the grain size of the resultant powder. The C, Cr, and Mo of the alloy mentioned above mainly promote enhancement of the wear resistance, and the Co and Ni mainly promote enhancement of the heat-resistance.

It is preferred that the hard alloy particles contain from 20% to 70% by weight of chromium and molybdenum. It is preferred that hard alloy particles contain from 10% to 50% by weight of cobalt and nickel. Molybdenum and chromium, as well as cobalt and nickel can be optionally selected within the above-mentioned ranges.

It is preferred that the above-mentioned carbon of from 0.5% to 1.5% by weight mentioned above be graphite which is mixed in with the raw sintering materials. The graphite should be mixed by weight with the raw sintering materials in an amount of from 0.8 part to 1.2 parts by weight with the proviso that iron powders are 100 parts. The graphite strengthens the matrix of the valve seat body.

Usually, the raw sintering materials consist of hard alloy particles, graphite powder, and an iron powder, which are mixed at an amount of from 5% to 30%, from 0.5% to 1.5%, and the balance being the iron powder, respectively.

The raw sintering materials which are used for producing skeleton of the valve seat body of the dual layer-sintered body is hereinafter referred to as the valve seat body powder.

Composition of the Base: The base carries the valve seat body and therefore makes it possible to reduce the amount of expensive alloying elements. Since the base according to the present invention must have a stiffness and strength which are equivalent to or greater than to those of the valve seat body, the ferrous sintered body of the base contains from 0.5% to 1.5% by weight of carbon, from 0.6% to 3.0% by weight of chromium, and at least one element selected from the group of phosphorus in an amount of from 0.1% to 0.6% by weight and boron in an amount of from 0.02 to 0.2% by weight.

Carbon renders the matrix of the ferrous sintered body of the base essentially pearlitic and enhances the strength of the matrix. When the amount of carbon is less than 0.5% by weight, ferrite is liable to form in the matrix of the ferrous sintered body, thereby reducing its strength. When the amount of carbon is more than 1.5% by weight, cementite is liable to form in the matrix of the ferrous sintered body of the base and is liable to embrittle.

Chromium is preferably contained in the ferrous sintered body in the form of ferrochromium, and, the ferrochromium phases are preferably dispersed in the ferrous sintered body of the base. The dispersed chromium-containing phases, such as the dispersed ferrochromium phases, bring about the so-called dispersion hardening and enhance the strength of the base. When the amount of chromium is less than 0.6% by weight, chromium is not effective for strengthning the base. When the amount of chromium is more than 3.0% by weight, strengthening of the base is not marked as compared with that attained when the amount of chromium is 3.0% by weight or less. In addition, it is economically disadvantageous to incorporate into the ferrous sintered body more than 3% by weight of chromium.

When not only chromium but also molybdenum, tungsten, and/or vanadium are incorporated in the form of a ferroalloy into the ferrous sintered body, dispersion-hardening can also be brought about.

Since phosphorus and boron form the Fe-P-C eutectic structure and the Fe-B-C eutetic structure, respectively, in the sintered Fe-C alloy, phosphorus or boron is conventionally used to enhance the wear resistance of ferrous sintered bodies. In the present invention, phosphorus and/or boron are used in a relatively small amount so as to prevent fomation of the eutectic structure and to generate minute liquid phases at numerous sites of the ferrous-sintered body of the base and thus to locally diminish and spheroidize the pores. When the minute liquid phases solidify, the ferrous sintered body of the base tends to shrink, and thus the solidifying minute liquid phases tend to suppress expansion of the ferrous sintered body during the fusion infiltration of copper or a copper alloy. If the ferrous sintered body of the base expands during the fusion, not only the density of the base is decreased, but also the dimensional accuracy of the base is impaired. Since phosphorus and/or boron are used in the present invention as an element(s) of the base, base having a high density, high stiffness, and a high dimensional accuracy can be obtained.

Phosphorus and/or boron are partially dissolved in the matrix of the ferrous sintered body of base and strengthen it.

When the amount of phosphorus is less than 0.1% by weight and when the amount of boron is 0.02% by weight, phosphorus and boron are not effective for increasing the density and and for strengthening the matrix of ferrous sintered body of the base. When the amount of phosphorus is more than 0.6% by weight, and when the amount of boron is more than 0.2% by weight, the amount of liquid phases is so great that a Fe-P-C eutectic or a Fe-BC eutectic structure is formed, and, further the ferrous-sintered body of the base embrittles.

It is preferred that the total amount of phosphorus and said boron be from 0.12% to 0.6% by weight and that the phosphorus amount, and the boron amount are from 0.2% to 0.4% by weight, and from 0.05% to 0.1% by weight, respectively.

The raw sintering materials for producing the base are usually an iron powder, a ferrochromium powder, a ferroboron powder, a ferrophosphorus powder, and a graphite powder. These powders are mixed together predetermined amounts. The ferroalloys may be those stipulated under the following Japanese Industrial Standard (JIS):

JIS G 2303 (ferrochromium);

JIS G 2318 (ferroboron); and,

JIS G 2310 (ferrophosphorus).

The ferrophsphorus and ferroboron powders are preferably in the form of fine particles 10 μm or less in size so that they can be uniformly distributed and to prevent phosphorus and boron from segregating and generating the eutectic structure.

Compacting the Powders: The base powder and the valve seat body powder are loaded into metal die in such a manner that these two powders form a dual layer. The base powder and the valve seat body powder are simultaneously subjected to compacting. The weight or volume proportion of the base powder to the valve seat body-powder is determined based on the proportion of the base to the value seat body in the dual-layer sintered valve seat ring, and the latter proportion is determined by the characteristics of an internal combusion engine. The density of a green compact, i.e., the compacted base powder and valve seat body powder, virtually determines the skeleton density and pore percentage of the dual-layer sintered body. Such compacting must therefore be carried out under such a pressure that the density of the skeleton of the dual-layer sintered body throughout the body is 6.7 g/cm$^3$ to 7.1 g/cm$^3$, and that the percentage of the sintered pores of the dual layer sintered body is 15% or less. When the density of the green compact is from 6.75 g/cm$^3$ to 7.15 g/cm$^3$, the skeleton has the density of from 6.7 g/cm$^3$ to 7.1 g/cm$^3$.

Skeleton Density: The density of skeleton of the dual-layer sintered body is from 6.7 g/cm$^3$ to 7.1 g/cm$^3$, and the dual-layer sintered body includes the sintered pores in an amount of from 15% or less. The density of the skeleton mentioned above is relatively high in the sintered ferrous articles because of the reasons explained in the following paragraph. The base powder and the valve seat body powder may be mainly comprised of reduced ferrous powder but preferably are mainly comprised the atomized powders since atomized powders have excellent compacting characteristics. The density of the skeleton should be uniform through the dual-layer sintered body. This can be achieved by utilizing a base powder and a valve seat body powder having virtually the same grain size and compacting characteristics. When the green compact is sintered, the dual-layer sintered body having the skeleton density and pores mentioned above are obtained. The sintering is preferably carried out at a temperature of from 1080° C. to 1150° C. in a reducing atmosphere for a period of from 30 to 60 minutes. The reducing atmosphere may be prepared by decomposing an ammonia gas or the like.

Fusion infiltration: The dual-layer sintered body is subjected to fusion infiltration of the sintered pores. Copper or a copper alloy is used for the fusion infiltration. The element used for fusion infiltration is hereinafter referred to as copper unless otherwise specified. Essentially all of the sintered pores other than isolated sintered pores are fusion infiltrated with copper.

When the first portions of the sintered pores, i.e., essentially all of the sintered pores other than the isolated sintered pores, are fusion infiltrated, and thus sealed, the stiffness is enhanced. Not only is the stiffness is enhanced, the bond between the base and the valve seat body is strengthened. Copper seems to strengthen the bonding by sealing the sintered pores which are present on the bonded surfaces of the base and the valve seat body, and, by bringing about diffusion between the base, and the valve seat body.

Since copper has an excellent thermal conductivity, the copper fusion infiltration in the first portions of the sintered pores reduces the thermal load during operation of an internal combustion engine and enhances the durability of the dual-layer sintered valve seat ring. It suppresses the creep deformation of the dual-layer sintered valve seat ring.

When the skeleton density is less than 6.7 g/cm$^3$ or when the percentage of the sintered pores is more than 15%, the amount of the fusion-infiltration copper becomes excessively large and the stiffness of the dual-layer sintered valve seat ring becomes low. When the density of the skeleton is more than 7.1 g/cm$^3$, the fusion-infiltration of copper is not effective for enhancing the stiffness, and the like.

For the fusion infiltration, both copper, and a copper alloy, such as a Cu-Fe-Mn alloy, a Cu-Fe-Mn-Zn alloy, or a Cu-Co-Zn alloy, may be used. The copper is located on the dual layer sintered body and is then infiltrated. Alternatively, the dual-layer sintered body may be dipped in the copper bath. Fusion-infiltration is carried out at a temperature of from 1080° to 1150° C. When the copper is located on the dual layer sintered body, and is then infiltrated, the amount of copper is preferably from 13% to 18% by weight based on the total weight of the dual layer sintered valve seat ring. Part of the copper is lost during the fusion infiltration, and part of it is fusion-infiltrated into the sintered pores.

The dual-layer sintered valve seat ring, i.e. the copper-infiltrated dual-layer sintered body, must have density of 7.6 g/m$^3$, or more, and the second portions of the sintered pores, that is the sintered pores into which the copper is not infiltrated, must be 5% or less.

The sintering and fusion-infiltration of copper may be simultaneously carried out.

Figure 2:
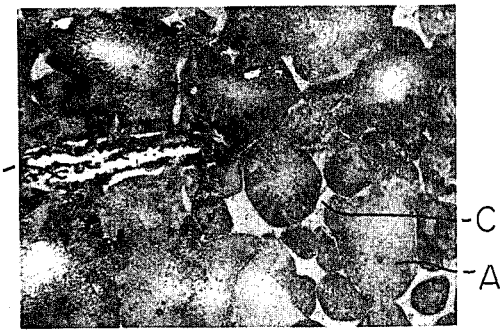
FIG. 2 shows the metal structure of the base at a magnification of 300.
Figure 3:
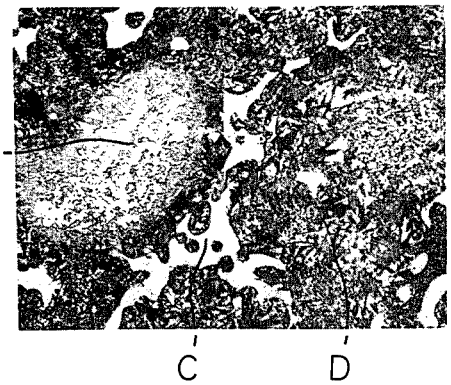
FIG. 3 shows the metal structure of the valve seat body at a magnification of 300.

Metal Structure: The metal structure of the base is discribed with reference to FIG. 2. In FIG. 2, A denotes the pearlite matrix, in which the boron and phosphorus are solid-dissolved. B denotes the ferrochromium particles which are uniformly distributed in the pearlite matrix A. C denotes the fusion-infiltrated copper which seals the first portions of the sintered pores. The continuous sintered pores are sealed by the fusion-infiltrated copper C, as is shown in FIG. 3. The base shown in FIG. 2 has a higher strength than a base having a plain pearlite matrix, because the ferrochromium particles B achieve the dispersion hardening, and further the boron or phosphorus is solid-dissolved in the pearlite matrix A and strengthens the matrix A.

The metal structure of the valve seat body is described with reference to FIG. 3. In FIG. 3, the symbol D denotes a martensite matrix, and the E denotes the hard alloy particles. The matrix has the martensite structure, because nickel, chromium, and molybdenum diffuse around the hard alloy particles E and into the matrix, and, further the fusion-infiltrated copper C diffuses into the matrix. The nickel, copper and the like form a solid solution in the matrix.

According to a comparative experiment carried out by the present invention, when the valve seat body was not subjected to the fusion-infiltration of copper, the matrix structure of the valve seat body was not martensitic.

It is therefore believed that the fusion-infiltration copper enhanced the diffusion of the alloy elements of hard alloy particles around them. It is to be noted that rapid cooling after fusion-infiltration of copper is not indispensable for forming the martensite matrix, and, thus air cooling is sufficient for forming a martensite matrix. A tempered martensite matrix (not shown in the drawings) is obtained when, after sintering the dual layer sintered valve seat ring is tempered. The martensite matrix and tempered matrix have a hardness of from Hv 500 to 700, and from Hv 300~500, respectively.

The base and the valve seat body may be formed concentrically and form the outer and inner parts, respectively, of the dual layer valve seatring.

EXAMPLES

The present invention is described with reference to the examples and the comparative examples. In these examples, the percentage is based on weight except for percentage of pores. In these examples and the comparative examples, the valve seat body powders was prepared by mixing the following (a), (b), and (c) in an amount so that the composition of the valve seat body given in Table 1 is obtained, and then adding into the mixture 0.8% of zinc strearate:

(a) the hard alloy particles: the crushed powder of −100 mesh, containing 2% of C, 20% of Cr, 8% of Ni, and 20% of Mo, 34% Co, the balance being Fe, and having the hardness was from Hv 700 to 800;

(b) the iron powder: the −100 mesh atomized powder; and, (c) the carbon powder: −325 mesh graphite powder.

The base powder was prepared by mixing the followings (a) through (e) with each other so as to give the composition of the base given in Table 1, and then adding into the mixture 0.8% of zinc stearate;

(a) −150 mesh atomized iron powder;

(b) −100 mesh ferrochromium powder (60% Cr);

(c) 10 μm or less of ferrophosphorus powder (25% P);

(d) 10 μm or less of ferro boron powder (20% B); and, (e) −325 mesh graphite powder The proportion of the base powder and the valve seat body-powder was selected so that the base and the valve seat body have the same height as each other. The base powder and the valve seat body-powder were successively loaded in a metal die so as to form a dual layer, and these powders were simultaneously compacted. The obtained green compact was sintered at 1130° C. for the period of 40 minutes in decomposed ammonia gas. Simultaneously with sintering, fusion infiltration was carried out. Copper alloy used for the fusion infiltration contained 3.8% of Fe, 2.2% of Mn, and 2.2% of Zn, the balance being Cu.

The dual-layer sintered valve seat rings were tempered at 700° C. for the period of one hour and then air cooled. The dual-layer sintered valve seat rings had an outer diameter of 31 mm, an inner diameter of 25 mm, and a height of 7 mm. These valve seat rings were subjected to measurement of stiffness.

Figure 4:
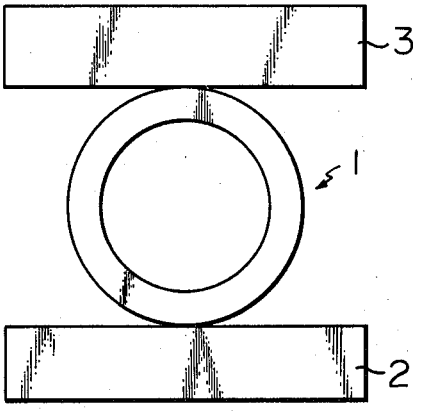
FIG. 4 is a schematic view of a ring-stiffness test.

The stiffness was measured as shown in FIG. 4. A constant load of 100 kgf was applied to each dual-layer sintered valve seat ring 1 in a radial direction by means of plates 2 and 3 and the deflection of such ring was measured. The smaller the deflection, the greater the stiffness.

Samples for measuring the tensile strength and Young's modulus were prepared. The samples comprised dual-layer base and valve seat body portions. Tensile stress was applied in a direction perpendicular to the dual layers.

The Young's modulus was obtained using the tensile stress and strain which did not exceeding the elastic limit.

The results of measurement are given in Table 1.

TABLE 1

| Examples | | Valve Seat Body Powder: Hard Alloy-Particles (%) | C (%) | C (*) | Fe (%) | Base Powder (%): Cr | P | B | C | Fe | Skeleton Density (g/cm³) | Amount of Cu-Fusion Infiltration (%) | Density After Infiltration (g/cm³) | Tensile Strength (kg/mm²) | Young's Modulus (kg/mm²) | Stiffness of Rings (Deflection) (mm) |
|---|---|---|---|---|---|---|---|---|---|---|---|---|---|---|---|---|
| Invention | 1 | 5 | 1.0 | 0.95 | bal | 0.6 | 0.1 | — | 1.0 | bal | 6.7 | 18 | 7.7 | 76 | 17500 | 0.21 |
| | 2 | 5 | 1.0 | 0.95 | bal | 0.6 | — | 0.02 | 1.0 | bal | 6.7 | 18 | 7.7 | 77 | 18000 | 0.20 |
| | 3 | 15 | 1.0 | 0.85 | bal | 1.5 | 0.3 | — | 1.0 | bal | 6.9 | 16 | 7.8 | 80 | 18400 | 0.20 |
| | 4 | 15 | 1.0 | 0.85 | bal | 1.5 | — | 0.1 | 1.0 | bal | 6.9 | 16 | 7.8 | 81 | 18600 | 0.19 |
| | 5 | 30 | 1.0 | 0.70 | bal | 3.0 | 0.6 | — | 1.0 | bal | 7.1 | 13 | 7.8 | 83 | 19500 | 0.19 |
| | 6 | 30 | 1.0 | 0.70 | bal | 3.0 | — | 0.2 | 1.0 | bal | 7.1 | 13 | 7.8 | 85 | 19200 | 0.18 |
| | 7 | 15 | 1.0 | 0.85 | bal | 1.5 | 0.2 | 0.05 | 1.0 | bal | 6.9 | 16 | 7.8 | 84 | 19000 | 0.18 |
| Comparative Examples | 1 | 30 | 1.0 | 0.70 | bal | 3.0 | 0.3 | 0.1 | 1.0 | bal | 7.1 | — | — | 38 | 13900 | 0.30 |
| | 2 | 20 | 1.0 | 0.80 | bal | 3.0 | — | — | 1.0 | bal | 6.9 | 16 | 7.8 | 65 | 14700 | 0.27 |
| | 3 | 20 | 1.0 | 0.80 | bal | — | 0.3 | — | 1.0 | bal | 6.9 | 16 | 7.8 | 66 | 15500 | 0.25 |
| | 4 | 20 | 1.0 | 0.80 | bal | — | — | 0.2 | 1.0 | bal | 6.9 | 16 | 7.8 | 63 | 14900 | 0.28 |
| | 5 | 20 | 1.0 | 0.80 | bal | 3.0 | 0.3 | 0.1 | 1.0 | bal | 6.5 | 20 | 7.8 | 61 | 15900 | 0.25 |
| | 6 | 20 | 1.0 | 0.80 | bal | 3.0 | 0.3 | 0.1 | 1.0 | bal | 6.5 | — | — | 32 | 11300 | 0.35 |

Note:
*Weight part based on iron powder of 100 parts.

In comparative example 1, the fusion-infiltration was not carried out. In comparative example 2, the base did not contain phosphorus and boron. In the comparative examples 3 and 4, the base did not contain chromium. In the comparative example 5, the skeleton density was low. In the comparative example 6, the skeleton density was low and the fusion-infiltration was not carried out. As is clear from Table 1, the stiffness of the examples 1~7 is superior to that of the comparative examples 1~6.

The dual-layer valve seat rings of the examples 1, 4, 5, and 7, and of the comparative examples 1, 2, 5, and 6 were mounted on the Al-alloy cylinder head of a water-cooled OHC gasoline-engine having four cylinders and total displacements of 1600 cc. The above mentioned four comparative examples correspond to the conventional ferrous sintered dual layer valve seat rings.

The durability of dual-layer valve seat rings used as exhaust valves seats was tested at 5,000 rpm and under a full load of the gasoline engine fou 400 hours. The fuel gasoline was no-lead gasoline.

The average amount of wear of the four dual-layer valve seat rings was obtained by measuring the variance in the tappet clearances.

The result are given in Table 2.

TABLE 2

| | Average Wear Amount (mm) |
|---|---|
| Examples 1 | 0.06 |
| Example 4 | 0.05 |
| Example 5 | 0.035 |
| Example 7 | 0.05 |
| Comparative Example 1 | 0.04 |
| Comparative Example 2 | 0.05 |
| Comparative Example 5 | 0.05 |
| Comparative Example 6 | 0.05 |

As is clear from Table 2, the wear resistance of the dual layer valve seat rings according to the present invention is comparable to that of conventional dual layer valve seat rings.

We claim:

1. A valve seat ring having a high strength and high stiffness and comprising a valve seat body having a surface in contact with a valve, and a base for supporting said valve seat body, said valve seat body and said base consisting of a ferrous sintered article having a dual-layer structure (hereinafter referred to as the dual-layer sintered body), wherein: said valve seat body comprises from 5% to 30% by weight of hard alloy particles having a hardness of Hv 500 or more and a matrix in which said hard alloy particles are dispersed and an alloying element of said hard alloy particles diffuses around said hard alloy particles and into said matrix; a ferrous sintered body of said base contains from 0.5% to 1.5% by weight of carbon, from 0.6% to 3.0% by weight of chromium, and at least one element selected from the group of phosphorus in an amount of from 0.1% to 0.6% by weight and boron in an amount of from 0.02% to 0.2%, based on the weight of said ferrous sintered body; and said dual-layer sintered body has a density of 7.6 g/cm$^3$ or more and comprises a skeleton, pores formed by sintering (hereinafter referred to as sintered pores), and copper or a copper alloy which is fusion-infiltrated into the first portions of said sintered pores, said skeleton having a density of from 6.7 g/cm$^3$ to 7.1 g/cm$^3$, the percentage of said sintered pores and the percentage of the second portions of said sintered pores, in which said copper or copper alloy is not fusion-infiltrated being 15% or less and 5% or less, respectively, based on the volume of said dual-layer sintered body.

2. A valve seat ring according to claim 1, wherein said valve seat body comprises from 10% to 25% by weight of hard alloy particles.

3. A valve seat ring according to claim 1, wherein said hard alloy particles contain from 20% to 70% by weight of chromium and molybdenum.

4. A valve seat ring according to claim 1, wherein said hard alloy particles contain from 10% to 50% by weight of cobalt and nickel.

5. A valve seat ring according to claim 1, wherein said carbon is graphite which is mixed in with raw sintering materials of said ferrous sintered body.

6. A valve seat ring according to claim 1, wherein said ferrous sintered body of the base contains from 0.8% to 1.2% of carbon.

7. A valve seat ring according to claim 1, wherein the matrix of said ferrous sintered body of the base essentially is a pearlite matrix.

8. A valve seat ring according to claim 1, wherein said chromium is contained in said ferrous sintered body of the base in the form of ferrochromium.

9. A valve seat ring according to claim 1, wherein the total content of said phosphorus and said boron is from 0.12% to 0.6% by weight.

10. A valve seat ring according to claim 1, wherein the phosphorus content is from 0.2% to 0.4% by weight and the boron content is from 0.05% to 0.1% by weight.

* * * * *